US008604983B2

(12) United States Patent
Pathak et al.

(10) Patent No.: US 8,604,983 B2
(45) Date of Patent: Dec. 10, 2013

(54) CRLH ANTENNA STRUCTURES

(76) Inventors: Vaneet Pathak, San Diego, CA (US); Gregory Poilasne, El Cajon, CA (US); Shane Thornwall, San Diego, CA (US); Tzung-I Lee, Los Angeles, CA (US); Alan Pasion, Carlsbad, CA (US); Norberto Lopez, San Diego, CA (US); Ajay Gummalla, Sunnyvale, CA (US)

( * ) Notice: Subject to any disclaimer, the term of this patent is extended or adjusted under 35 U.S.C. 154(b) by 298 days.

(21) Appl. No.: 13/021,027

(22) Filed: Feb. 4, 2011

(65) Prior Publication Data

US 2012/0001804 A1 Jan. 5, 2012

Related U.S. Application Data

(60) Provisional application No. 61/302,121, filed on Feb. 6, 2010, provisional application No. 61/311,206, filed on Mar. 5, 2010.

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 846, 895
See application file for complete search history.

(56) References Cited

U.S. PATENT DOCUMENTS

| | | | | |
|---|---|---|---|---|
| 4,691,206 | A * | 9/1987 | Shapter et al. | 343/700 MS |
| 5,668,561 | A * | 9/1997 | Perrotta et al. | 343/702 |
| 6,803,881 | B2 * | 10/2004 | Ishihara et al. | 343/700 MS |
| 7,053,840 | B2 * | 5/2006 | Hilgers | 343/702 |
| 7,271,771 | B2 * | 9/2007 | Usui et al. | 343/702 |
| 7,477,195 | B2 * | 1/2009 | Vance | 343/700 MS |

* cited by examiner

*Primary Examiner* — Tho G Phan

(57) ABSTRACT

A variety of configurations for a CRLH structured antenna in a wireless device are presented. An antenna having portions of the CRLH structure positioned on different layers provides an elevated structure. An antenna is presented having a double folded antenna structure, wherein a cell patch includes extensions on multiple layers of a substrate.

20 Claims, 15 Drawing Sheets

--PRIOR ART--

--PRIOR ART--

--PRIOR ART--

CRLH ANTENNA STRUCTURES

PRIORITY CLAIMS AND RELATED APPLICATIONS

This application claims the benefit of priority under 35 U.S.C. 119(e) to U.S. Provisional Patent Application Ser. No. 61/302,121, entitled "DOUBLE FOLDED ANTENNA," filed on Feb. 6, 2010, and to U.S. Provisional Patent Application Ser. No. 61/311,206, entitled "MULTI-ELEVATED AND DISTRIBUTED METAMATERIAL ANTENNA DEVICE," filed on Mar. 5, 2010, both of which are incorporated herein by reference in their entireties.

BACKGROUND

As wireless device functionality and complexity increase, and as the size of such devices decreases, the area available to incorporate features and components is reduced. Therefore, optimal use of the available footprint provides a compact, densely functioned device. The use of Composite Right/Left Hand (CRLH) structures allows the antenna structure to be positioned on available substrate space. As the CRLH configuration may be done after design of other components, the designer may prioritize placement of functional components and utilize remaining space for CRLH structures. To this end, a variety of techniques and configurations may be used to design such CRLH based designs.

DETAILED DESCRIPTION

Figure 2:
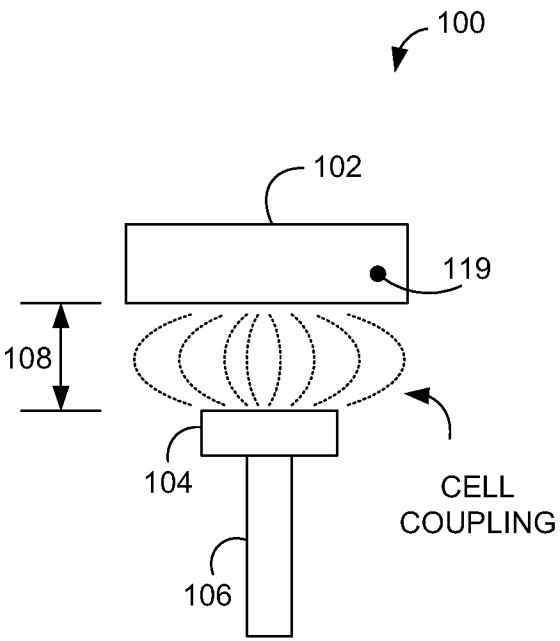
FIGS. 1-3 illustrate prior art metamaterial-based resonator structures.

A metamaterial structure, also referred to as MTM structure, MTM-based structure, MTM-inspired structure, or MTM-type structure, may be a combination or mixture of a Left Hand (LH) MTM structure and a Right Hand (RH) structure; these combinations are referred to as Composite Right and Left Hand (CRLH) metamaterials. A CRLH metamaterial behaves like an LH metamaterial under certain conditions, such as for operation at low frequencies; the same CRLH metamaterial may behave like an RH material under other conditions, such as operation at high frequencies.

Implementations and properties of various CRLH MTMs are described in, for example, Caloz and Itoh, "Electromagnetic Metamaterials: Transmission Line Theory and Microwave Applications," John Wiley & Sons (2006). CRLH MTMs and their applications in antennas are described by Tatsuo Itoh in "Invited paper: Prospects for Metamaterials," Electronics Letters, Vol. 40, No. 16 (August, 2004).

CRLH MTMs may be structured and engineered to exhibit electromagnetic properties tailored to specific applications. Additionally, CRLH MTMs may be used in applications where other materials may be impractical, infeasible, or unavailable to satisfy the requirements of the application. In addition, CRLH MTMs may be used to develop new applications and to construct new devices that may not be possible with RH materials and configurations.

As used in this application, MTM and CRLH MTM structures and components are based on a technology called "Metamaterial" which applies the concept of Right-handed and Left-handed (LH) structures.

As used herein, the term "Metamaterial," "MTM," "CRLH," and "CRLH MTM" refer to technology and technical means, methods, devices, inventions and engineering works which allow compact devices composed of conductive and dielectric parts and are used to receive and transmit electromagnetic waves and behave as unique structures which are much smaller than the free space wavelength of the propagating electromagnetic waves. Using MTM technology, antennas and RF components may be made very compactly in comparison to competing methods and may be very closely spaced to each other or to other nearby components while at the same time minimizing undesirable interference and electromagnetic coupling. Such antennas and RF components further exhibit useful and unique electromagnetic behavior that results from one or more of the following structures to design, integrate, and optimize antennas and RF components inside wireless communications devices.

Composite Right Left Handed (CRLH) structures exhibit simultaneous negative permittivity ($\in$) and permeability ($\mu$) within certain frequency bands and simultaneous positive $\in$ and $\mu$ within other frequency bands.

Transmission-Line (TL) based CRLH structures enable TL propagation and exhibit simultaneous negative permittivity ($\in$) and permeability ($\mu$) within certain operating frequency bands and simultaneous positive $\in$ and $\mu$ within other operating frequency bands TL-based Left-Handed (TL-LH) structures enable TL propagation and exhibit simultaneous negative $\in$ and $\mu$ within certain frequency bands and simultaneous positive $\in$ and $\mu$ within extremely high-frequency non operating bands.

Combination of the above may be designed and built incorporating conventional RF design structures. Antennas, RF components and other devices may be referred to as "MTM antennas," "MTM components," and so forth, when they are designed to behave as an MTM structure. MTM components may be easily fabricated using conventional conductive and insulating materials and standard manufacturing technologies including but not limited to: printing, etching, and subtracting conductive layers on substrates such as FR4, ceramics, LTCC, MMICC, flexible films, plastic or even paper.

The propagation of electromagnetic waves in most materials obeys the right-hand rule for the (E,H,$\beta$) vector fields, which denotes the electrical field E, the magnetic field H, and the wave vector $\beta$ (or propagation constant). In these materials, the phase velocity direction is the same as the direction of the signal energy propagation (group velocity) and the refractive index is a positive number. Such materials are referred to as Right/Handed (RH) materials. Most natural materials are RH materials, but artificial materials may also be RH materials.

A metamaterial (MTM) is an artificial structure which behaves differently from a natural RH material alone. Unlike RH materials, a metamaterial may exhibit a negative refractive index, wherein the phase velocity direction is opposite to the direction of the signal energy propagation where the relative directions of the (E,H,$\beta$) vector fields follow a left-hand rule. When a metamaterial is designed to have a structural average unit cell size $\rho$ which is much smaller than the wavelength of the electromagnetic energy guided by the metamaterial, the metamaterial behaves like a homogeneous medium to the guided electromagnetic energy. Metamaterials that support only a negative index of refraction with permittivity $\in$ and permeability $\mu$ being simultaneously negative are pure Left Handed (LH) metamaterials.

A metamaterial structure may be a combination or mixture of an LH metamaterial and an RH material; these combinations are referred to as Composite Right and Left Hand (CRLH) metamaterials. A CRLH metamaterial behaves like an LH metamaterial under certain conditions, such as for operation at low frequencies; the same CRLH metamaterial may behave like an RH material under other conditions, such as operation at high frequencies.

Implementations and properties of various CRLH MTMs are described in, for example, Caloz and Itoh, "Electromagnetic Metamaterials: Transmission Line Theory and Microwave Applications," John Wiley & Sons (2006). CRLH MTMs and their applications in antennas are described by Tatsuo Itoh in "Invited paper: Prospects for Metamaterials," Electronics Letters, Vol. 40, No. 16 (August, 2004).

CRLH MTMs may be structured and engineered to exhibit electromagnetic properties tailored to specific applications. Additionally, CRLH MTMs may be used in applications where other materials may be impractical, infeasible, or unavailable to satisfy the requirements of the application. In addition, CRLH MTMs may be used to develop new applications and to construct new devices that may not be possible with RH materials and configurations.

As used in this application, MTM and CRLH MTM structures and components are based on a technology called "Metamaterial" which applies the concept of RH and LH structures.

As used herein, the term "Metamaterial," "MTM," "CRLH," and "CRLH MTM" refer to technology and technical means, methods, devices, inventions and engineering works which allow compact devices composed of conductive and dielectric parts and are used to receive and transmit electromagnetic waves and behave as unique structures which are much smaller than the free space wavelength of the propagating electromagnetic waves. Using MTM technology, antennas and RF components may be made very compactly in comparison to competing methods and may be very closely spaced to each other or to other nearby components while at the same time minimizing undesirable interference and electromagnetic coupling. Such antennas and RF components further exhibit useful and unique electromagnetic behavior that results from one or more of the following structures to design, integrate, and optimize antennas and RF components inside wireless communications devices.

CRLH structures exhibit simultaneous negative permittivity ($\in$) and permeability ($\mu$) within certain frequency bands and simultaneous positive $\in$ and $\mu$ within other frequency bands.

Transmission-Line (TL) based CRLH structures enable TL propagation and exhibit simultaneous negative permittivity ($\in$) and permeability ($\mu$) within certain operating frequency bands and simultaneous positive $\in$ and $\mu$ within other operating frequency bands TL-based Left-Handed (TL-LH) structures enable TL propagation and exhibit simultaneous negative $\in$ and $\mu$ within certain frequency bands and simultaneous positive $\in$ and $\mu$ within extremely high-frequency non operating bands.

Combination of the above may be designed and built incorporating conventional RF design structures. Antennas, RF components and other devices may be referred to as "MTM antennas," "MTM components," and so forth, when they are designed to behave as an MTM structure. MTM components may be easily fabricated using conventional conductive and insulating materials and standard manufacturing technologies including but not limited to: printing, etching, and subtracting conductive layers on substrates such as FR4, ceramics, LTCC, MMICC, flexible films, plastic or even paper.

A CRLH MTM design may be used in a variety of applications, including wireless and telecommunication applications. The use of a CRLH MTM design for elements within a wireless application often reduces the physical size of those elements and improves the performance of these elements. In some embodiments, CRLH MTM structures are used for antenna structures and other RF components.

CRLH MTM structures may be used in wireless devices having a variety of features, components and elements. The space available for layout of the various components of the device may be challenging, as the components must be positioned to meet a specification. In some cases, it may be necessary to reroute connection lines or modify the shape of a component for incorporation into a device design. For example, a component may be distributed over a given surface, or otherwise shaped for implementation with other elements In one example, a wireless device has a microphone positioned at an end of the device to optimize performance during use. The microphone is placed near the expected mouth position of the user. This is often at the bottom of the device. When an antenna or other component is designed for such a device, there is a requirement to avoid the component space designated for the microphone. To avoid the microphone, a CRLH structure may be implemented for an antenna, wherein a first part of the radiator is positioned on a first surface proximate the designated component space. A second part of the radiator is then positioned on an opposite surface of the substrate, and connected to the first part through a conducting via placed through the substrate. A third part of the radiator may then be positioned on the first surface proximate the microphone, and having connection to the second part of the radiator through a second conducting via through the substrate. In this way, the area of the radiator, or antenna structure, is sufficient for the specification, while maintaining the position of the microphone on the device.

Figure 1:
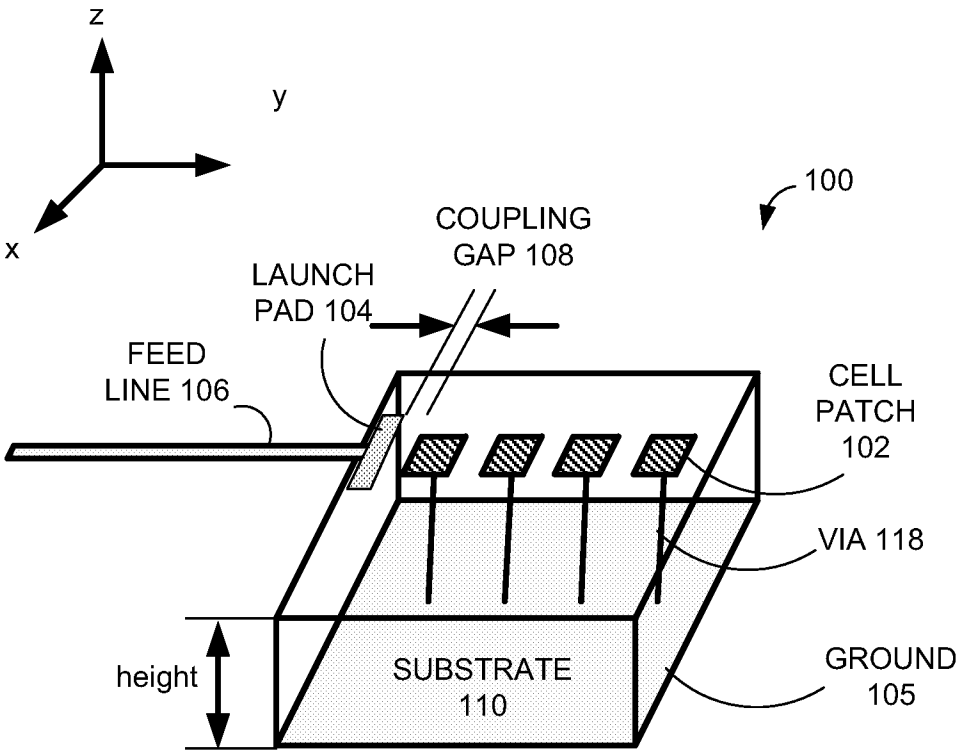

Consider the structure of FIG. 1, which illustrates a prior art antenna 100 configured on a substrate 110. The antenna 100 incorporates a CRLH metamaterial structure or configuration, which is a structure that acts as an LH metamaterial under some conditions and acts as an RH material under other conditions. In this way, a CRLH MTM structure behaves like an LH metamaterial at low frequencies and an RH material at high frequencies. CRLH MTMs are structured and engineered to exhibit electromagnetic properties tailored for the specific application and used to develop new applications and to construct new devices. An MTM antenna may be built using a variety of materials, wherein the structure behaves as a CRLH material. In other words, the antenna structure acts as a metamaterial structure which is a combination of an LH metamaterial and an RH material; the antenna structure behaves as a CRLH metamaterial, which behaves as an LH metamaterial at low operational frequencies and behaves like an RH material high operational frequencies.

The antenna 100 includes a plurality of unit cells which each act as a CRLH MTM structure. Each unit cell includes a cell patch 102 and a via 118, wherein the via 118 couples the cell patch 102 to a ground electrode 105. A launch pad 104 is configured proximate one of the cell patches 102, such that signals received on a feed line 106 are provided to the launch pad 104. The signal transmissions cause charge to accumulate on the launch pad 104. From the launch pad 104 electrical charge is induced onto the cell patch 102 due to electromagnetic coupling between the launch pad 104 and the cell patch 102. Similarly, for signals received at the antenna, charge accumulates on the cell patch 102, and the charge is induced onto the launch pad 104.

The substrate 110 may include multiple layers, such as two conductive layers separated by a dielectric layer. In such a configuration, elements of the antenna 100 may be printed or formed on a first layer using a conductive material, while other elements are printed or formed on a second layer. One of the first and second layers may include a ground electrode. The antenna element in the first layer may be electrically coupled to the antenna element in the second layer through connections, such as conductors or vias, extending through the substrate.

The cell patches 102 are the radiators of the antenna 100, which are configured along a first layer or surface of a substrate 110. For clarity the surface on which the cell patches 102 are formed is referred to as the top layer. The second surface is then referred to as the bottom layer.

Within the top surface, each cell patch 102 is separated from a next cell patch 102 by a coupling gap 108. Further, a coupling gap 108 spaces a terminal cell patch 102 and a corresponding launch pad 104. The launch pad 104 is coupled to a feed line 106 for providing signals to and receiving signals from the cell patch 102. Each cell patch 102 is coupled to the bottom surface of the substrate 110 by via 118. The bottom surface of the substrate 110 may be a ground plane or may include a truncated ground portion, such as a ground electrode patterned onto the bottom layer.

FIG. 2 further illustrates the cell coupling which exists between the cell patch 102 and the launch pad 104 of antenna 100. As illustrated, the cell coupling occurs within the coupling gap 108. As illustrated, the launch pad 104 is coupled to the feed line 106, and receives electrical signals for transmission from the antenna 100. The electrical voltage present on the launch pad 104 has an impact on the cell patch 102 due to the cell coupling. In other words, an electrical voltage is generated on the cell patch 102 due to the behavior of the launch pad 104. The amount of cell coupling is a function of the geometries of the launch pad 104, the cell patch 102 and the coupling gap 108. As illustrated, the cell patch 102 has a via connection point 119 which couples to via 118.

Figure 3:
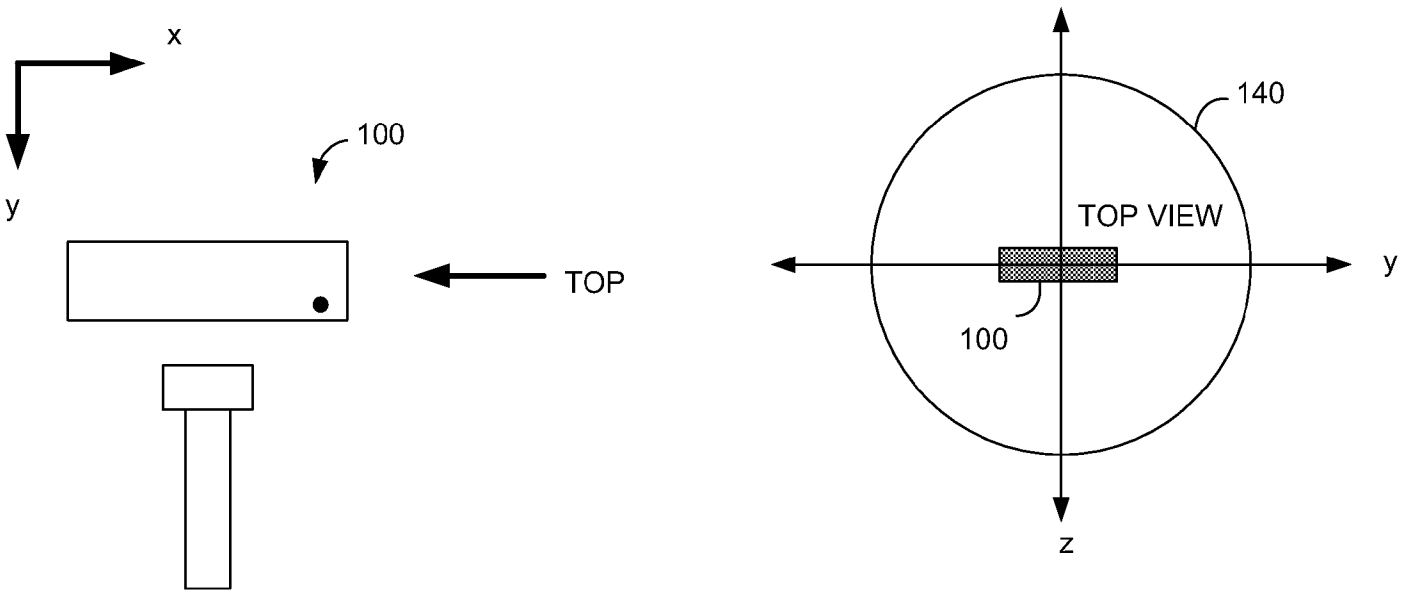
Figure 4:
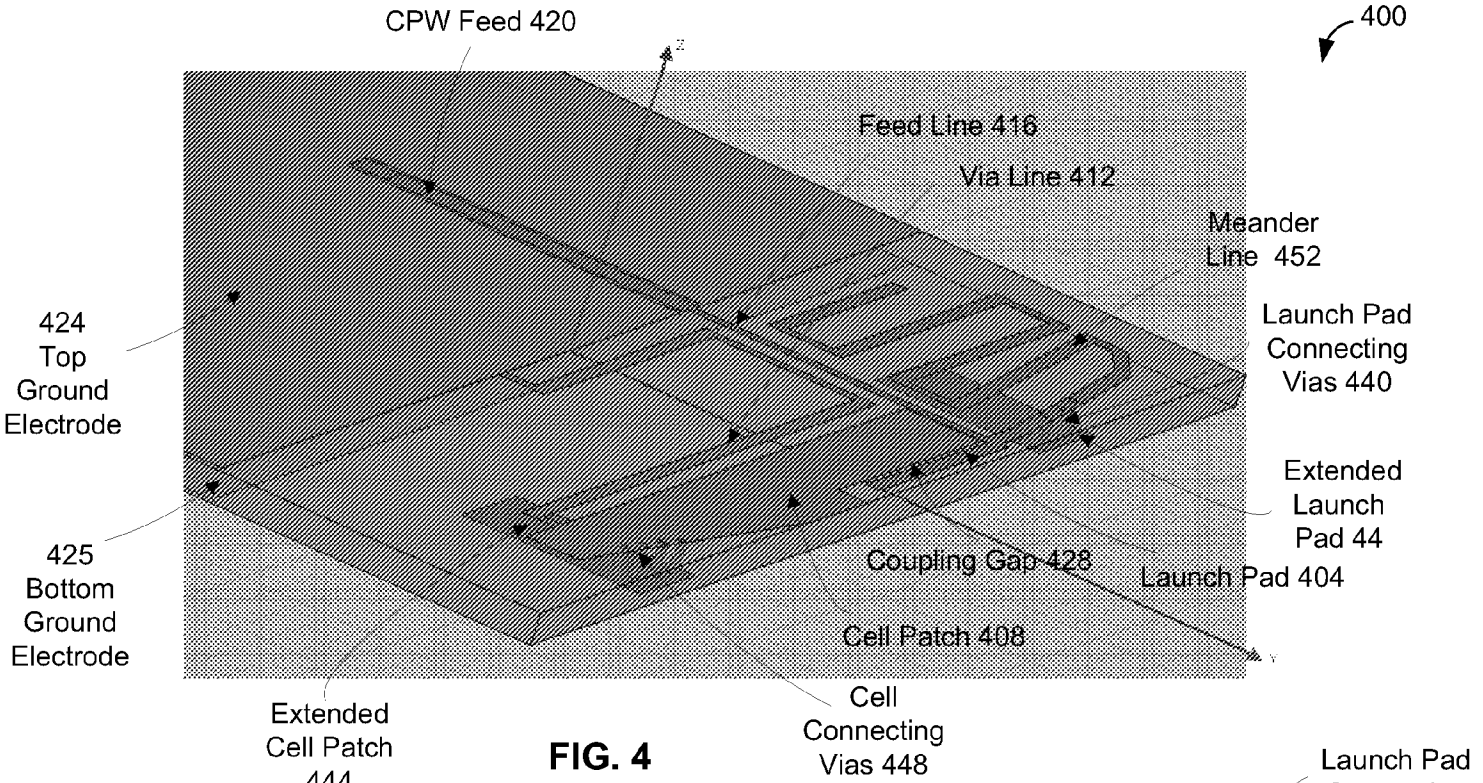
FIGS. 4 to 7 illustrate multi-band antennas CRLH structures, according to example embodiments.
Figure 5:
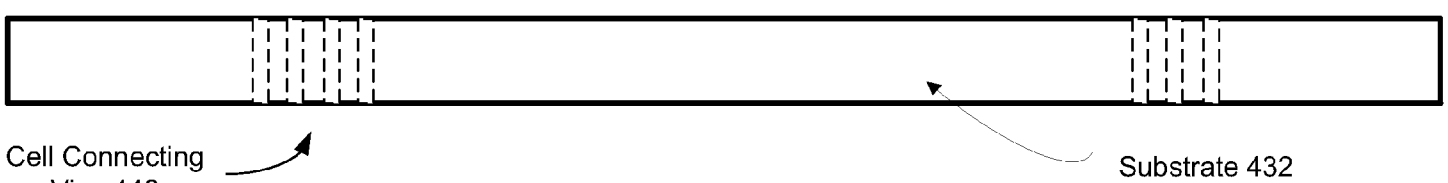

FIG. 3 illustrates the radiation pattern generated by the antenna 100 of FIG. 1. The shape of the antenna is illustrated in an x-y plane and a radiation pattern 140 illustrated for the y-z plane. As illustrated, in the y-z plane the radiation pattern 140 has an approximately circular shape around the cell patch 102. The planes are illustrated and labeled for clarity and understanding of the features of the embodiment. The antenna 100 generates an effectively non-directional radiation pattern 140. In this embodiment, the cell patch 102 is a rectangular shape, wherein the size and configuration of the elements of the antenna changes the intensity and shape of the resultant radiation pattern.

FIGS. 4 to 7 illustrate an example of a penta-band antenna with a semi single-layer structure, wherein a cell patch of the antenna is provided on multiple layers, according to an example embodiment. In this design, a cell includes two metal patches that are respectively formed in the top and bottom metallization layers and are connected by conductive vias. Of the two metal patches, the cell patch 408 in the top layer is larger in size than the extended cell patch 444 in the bottom layer and thus is the main cell patch. The extended cell patch 444 in the bottom layer is not connected to a ground electrode. A via line 412 is formed in the top layer, the same layer of the cell patch 408, to connect the cell patch 408 to the top ground electrode 424. As such, the top ground electrode 424 is the ground electrode for the cell patch 408. Therefore, this device does not have a bottom truncated ground for the cell in the bottom layer. For this reason, this design is a "semi single-layer structure."

More specifically, this MTM antenna has a launch pad 404 with an added meander line 452 and a cell patch 408, all of which are on the top layer. The cell patch 408 is extended to an a cell patch extension 444 in the bottom layer by using one or more vias 448 to connect the cell patch 408 on the top and the cell patch extension 444 on the bottom. The launch pad 404 may also be extended to an a launch pad extension 436 in the bottom layer by using one or more vias 440 to connect the launch pad 404 on the top and the launch pad extension 436 on the bottom. The launch pad extension 436 on the bottom layer can also be referred to as an extended launch pad 436, and the cell patch extension 444 on the bottom layer can also be referred to as an extended cell patch 444. The respective vias are referred to as launch pad connecting vias 440 and cell connecting vias 448 in the figures. Such extensions can be made to comply with the space requirements while maintaining a certain performance level.

Figure 7:
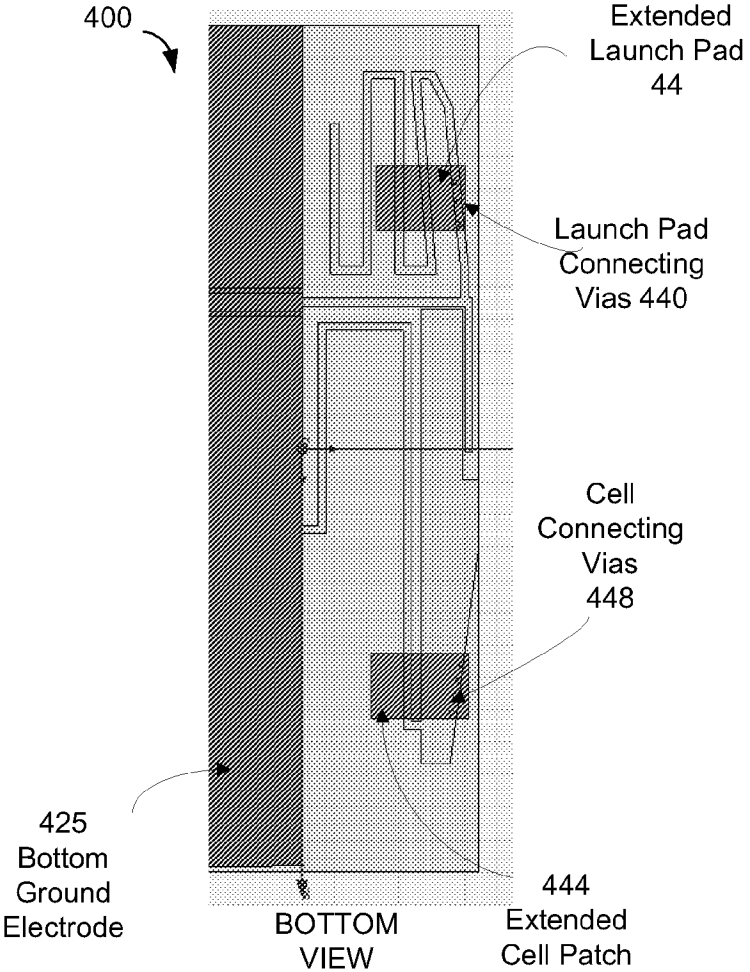
Figure 6:
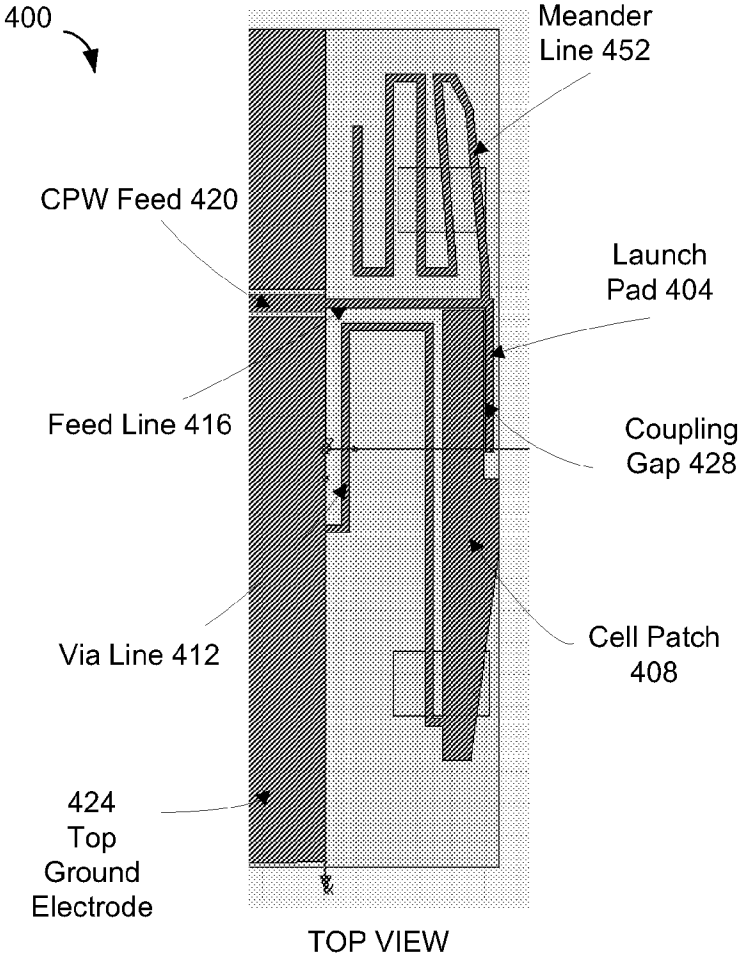

FIG. 7 illustrates the bottom layer that is overlaid with the top layer. FIG. 6 illustrates the top layer that is overlaid with the bottom layer.

The antenna is fed by a grounded CPW feed 420 with a characteristic impedance of 50Ω. The feed line 416 connects the CPW feed 420 to the launch pad 404, which has the added meander line 452. The cell patch 408 has a polygonal shape, and capacitively coupled to the launch pad 404 through a coupling gap 428. The cell patch 408 is shorted to the top ground electrode 424 on the top layer through via line 412, wherein the route of via line 412 is optimized for matching. The substrate 432 can be made of a suitable dielectric material, e.g., an FR4 material.

Table 1 provides a summary of the elements of the semi single-layer penta-band MTM antenna structure in this example. Other configurations, layouts and layering may be used to implement CRLH structures.

TABLE 1

| Parameter | Description | | Location |
|---|---|---|---|
| Antenna Element | Each antenna element comprises a cell connected to a 50 Ω CPW Feed 420 via a Launch Pad 404 and a Feed Line 416. Both Launch Pad 404 and Feed Line 416 are located on the top layer of Substrate 432. | | Multi-layer |
| Feed Line | Connects the Launch Pad 404 with the 50 Ω CPW Feed 420. | | Top Layer |
| Launch Pad | Rectangular shaped and is coupled to a Cell Patch 408 through a Coupling Gap 428. A Meander Line 452 is attached to the Launch Pad 404. | | Top Layer |
| Meander Line | Added to the Launch Pad 404. | | Top Layer |
| Extended Launch Pad | A rectangular shaped patch that is an extension of the Launch Pad 404. | | Bottom Layer |
| Launch Pad Connecting Vias | Vias connecting the Launch Pad 404 on the top layer with the Extended Launch Pad 436 on the bottom layer. | | Bottom Layer |
| Cell | Cell Patch | Polygonal shape | Top Layer |
| | Extended Cell Patch | A rectangular shaped patch that is an extension of the Cell Patch 408. | Bottom Layer |
| | Via Line | Line that connects the Cell Patch with the top ground electrode 424. | Top Layer |
| | Cell Connecting | Vias connecting the Cell Patch 408 on the top layer | Through Dielectric |

TABLE 1-continued

| Parameter | Description | | Location |
|---|---|---|---|
| | Vias | with the Extended Cell Patch 444 on the bottom layer. | through Top Layer and Bottom Layer |

Figure 8:
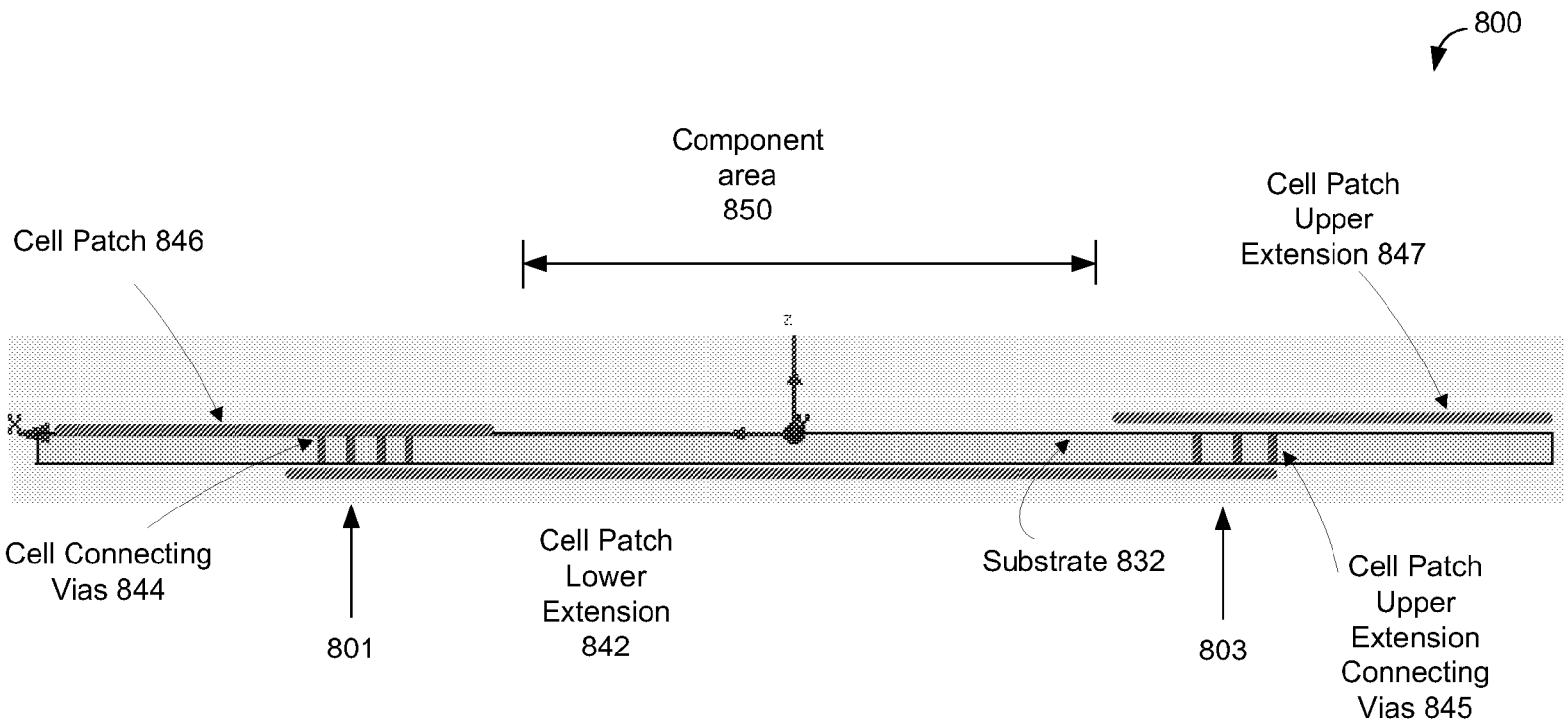
FIGS. 8 to 11 illustrate antenna structures with radiating elements formed on a substrate material, according to example embodiments.

FIG. 8 illustrates a side view of a portion of a device having a substrate 832 having an upper layer and a lower layer. An antenna structure 800 is formed on the substrate 832. The antenna structure 800 is a CRLH structure, and behaves as a metamaterial. The antenna structure includes a cell patch 846 for radiating signals from the antenna structure. A cell patch 846 is formed on the upper layer at a first position of the substrate 832. Identified on the substrate 832 is further a component area 850 in which a component of a wireless device is to be placed. In one example the component is a microphone which is to be placed at component area 850. Often the position of the microphone or other component is fixed and cannot be changed during design in order to meet specifications. The cell patch 846 is designed to fill a desired area so as to ensure the radiating signals from the device are according to specified performance. Similarly, the desired area for cell patch 846 is to ensure receipt of signals originating from another wireless device or system point. In the device, however, the position of the microphone at component area 850 prevents the cell patch 846 from further extension on the upper layer of the substrate 832. To accommodate the performance criteria of the antenna while allowing for the component configuration of the device, via(s) 844 are positioned on one side of the component area 850 to connect the cell patch 846 to a cell patch lower extension 842.

The lower cell patch extension 842 is formed on the opposite layer or side of the substrate 832 and runs underneath, and approximately parallel to, the component area 850. The design then continues to optimize the space available, by providing via(s) 845 to connect the cell patch lower extension 844 to the cell patch upper extension 847. In this way, the effective length of the cell patch is the sum of the areas of the cell patch 846, the cell patch lower extension 842 and the cell patch upper extension 847. The layout and configuration of the antenna portions to avoid the component area 850 is referred to as a double folded antenna, where folds occur at points 801 and 803. Each time a cell patch continues onto another layer, the cell patch is considered a folded cell patch.

Figure 10:
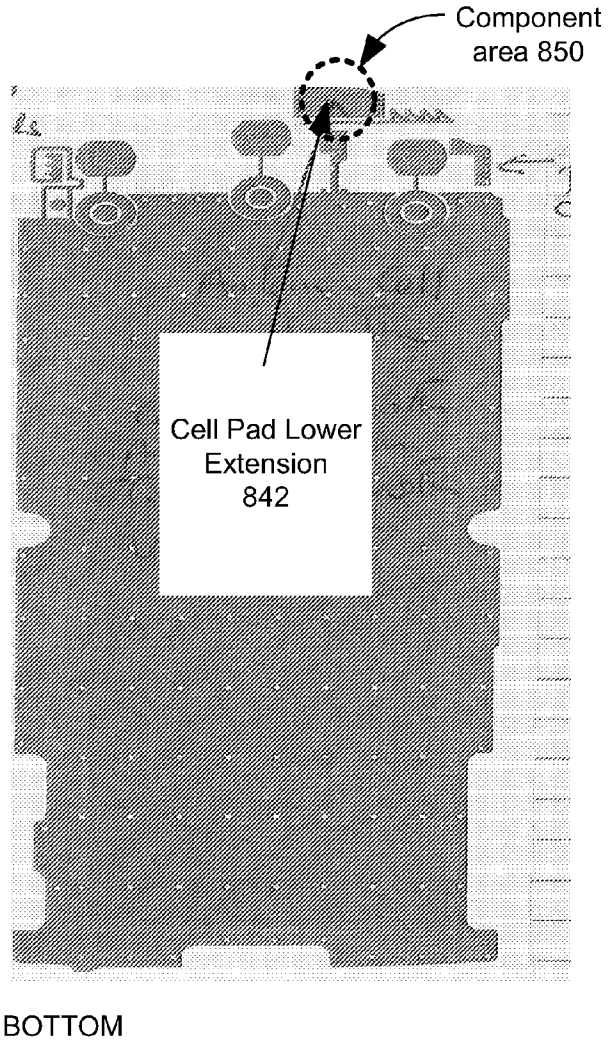
Figure 9:
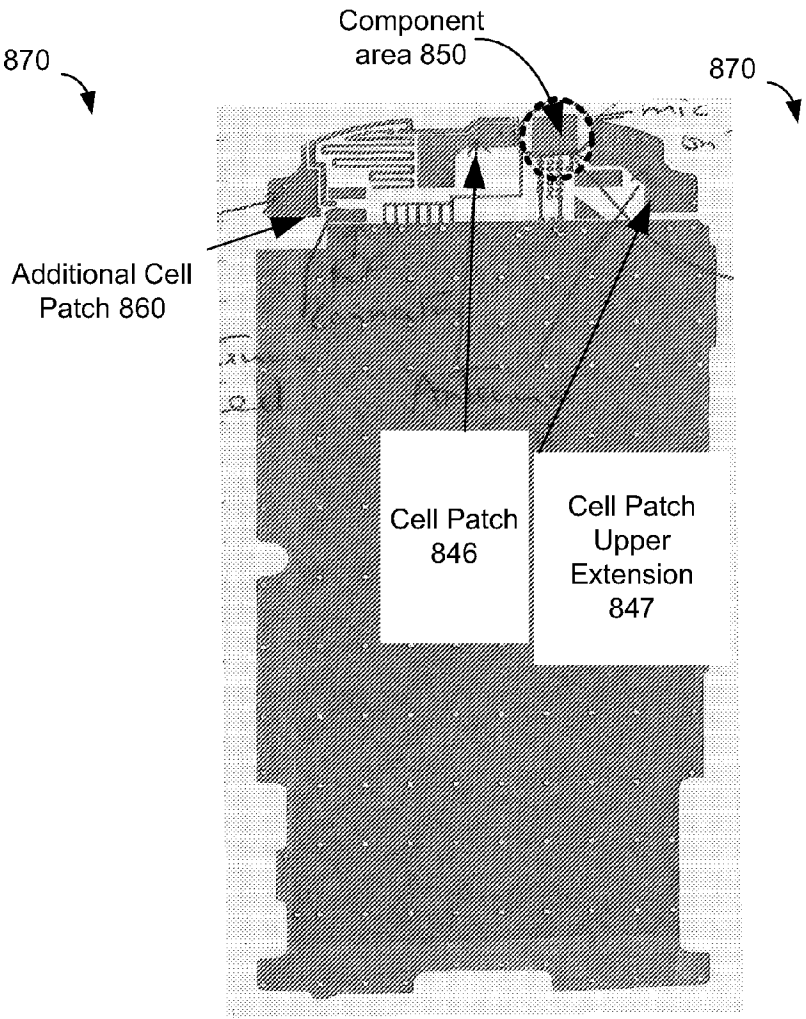
Figure 11:
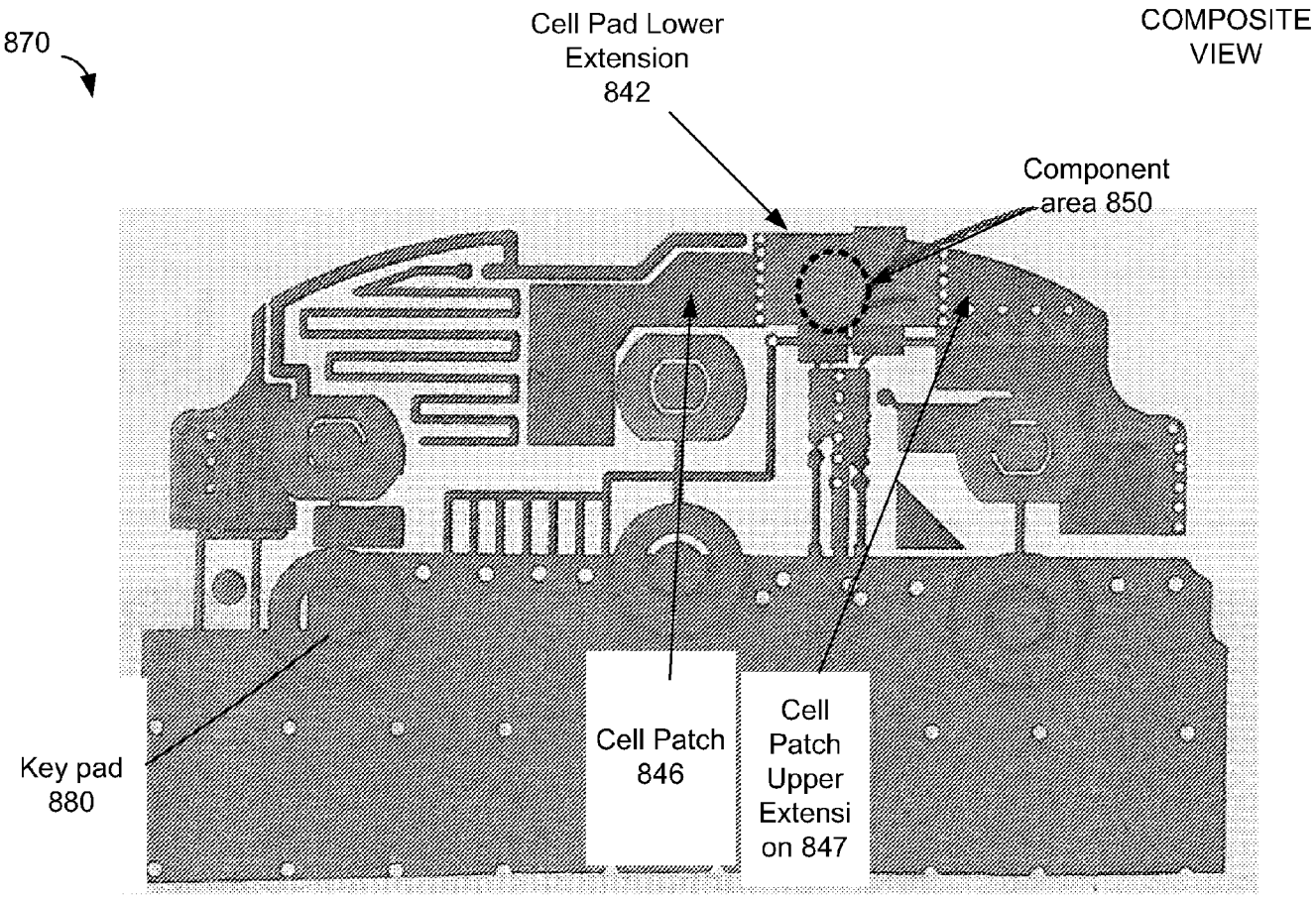

FIG. 9 illustrates a top view of the antenna 800 as positioned in the device 870. The component area 850 is illustrated at one end of the device 870. The cell patch 846 is positioned on one side of the component area 850, while the cell patch upper extension 847 is positioned on the opposite side. The device 870 includes an additional cell patch 860. FIG. 10 illustrates a bottom view of the device 870 wherein the component area 850 is where the cell patch lower extension 842 is formed. The antenna structure 800 includes antenna feed lines which couple to the cell patch 846 and the additional cell patch 860. FIG. 11 illustrates a composite view of the device 870, which identifies the position of the cell pad upper extension 847 and the keypads 880 and other structures and features of device 870. As illustrated, the antenna structure is positioned in the available space after implementation of these features, such as the keypads. In some embodiments, the antenna structures are designed prior to placement of some features and components.

Figure 12:
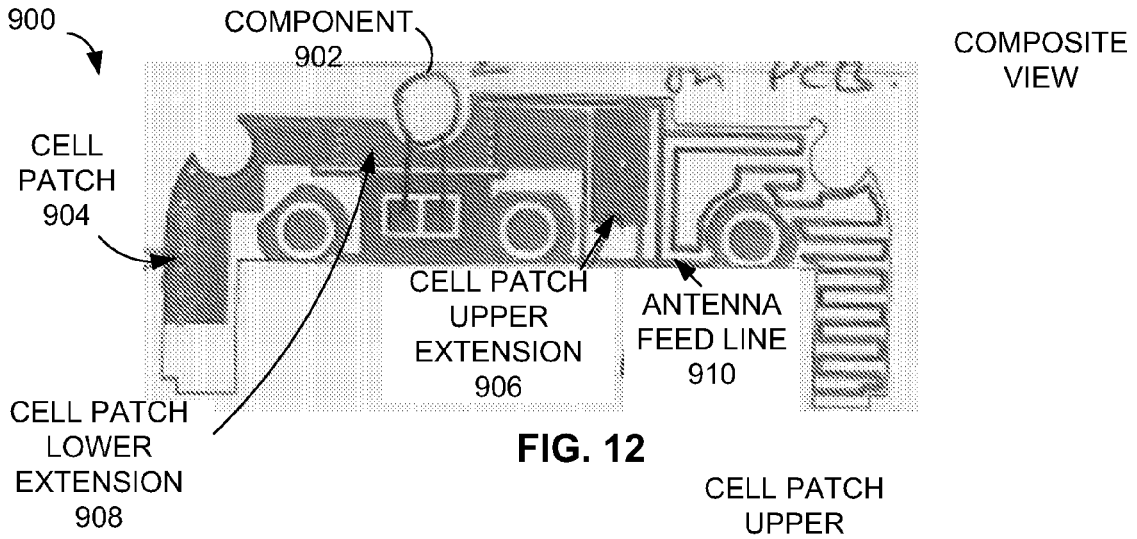
FIGS. 12 to 14 illustrate an antenna structure with radiating elements formed on layers of a substrate material, according to an example embodiment.
Figure 13:
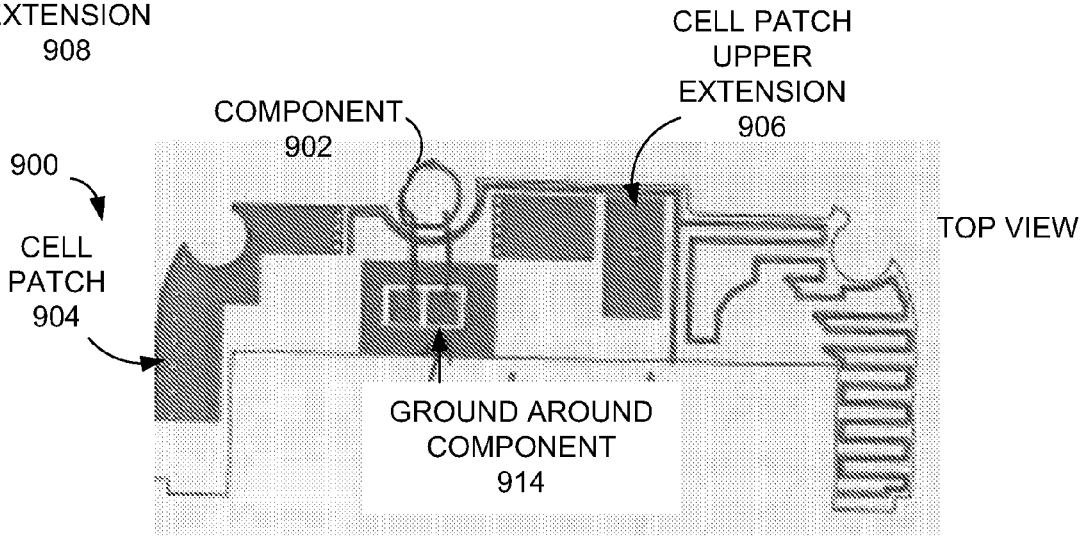
Figure 14:
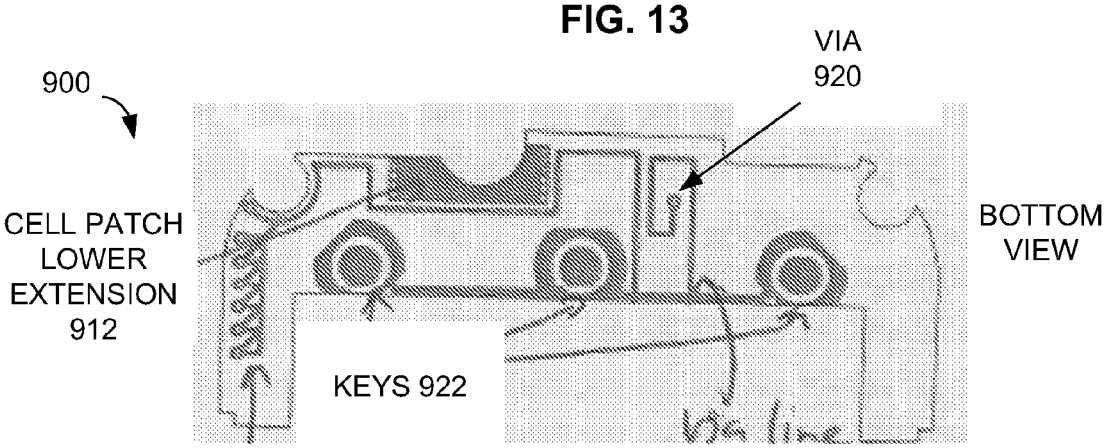

FIGS. 12, 13 and 14 illustrate composite, top and bottom views of a portion of a device 900 having an antenna structure including cell patch 904, cell patch upper extension 906, cell patch lower extension 908. The antenna feed line 910 is illustrated proximate the cell patch upper extension 906. A ground portion 914 is formed around the component 902. As illustrated, keys 922 are positioned near the component 902. In one embodiment the component 902 is a microphone.

As discussed herein, a CRLH design may be used in a variety of applications, including wireless and telecommunication applications. The use of a CRLH or MTM based design for elements within a wireless application often reduces the physical size of those elements and improves the performance of these elements. In some embodiments, CRLH structures are used for antenna structures and other RF components.

CRLH structures may be used in wireless devices having a variety of features, antenna structures and elements. The space available for layout of the various antenna structures of the device may be challenging, as the components must be positioned to meet certain layout constraints such as device enclosure size and dimensions. In some cases, it may be necessary to reroute connection lines or modify the shape of a component for incorporation into a device design. Rerouting connection lines and adapting the shape of the components do provide some relief and additional space savings necessary to meet these layout constraints. However, as the devices continue to get smaller, rerouting lines and adapting the shape may not be enough to meet smaller design requirements, especially on compact wireless devices that are formed on a single PCB or other substrate. Thus, alternative and novel designs and methods of producing antenna structures that can maximize the use of a limited area may be of increasing interest as the layout constraints continue to shrink.

CRLH structures provide several benefits for constructing a compact antenna while supporting a broad range of frequencies. Some of these structures are described in the U.S. patent application Ser. No. 12/270,410 entitled "Metamaterial Structures with Multilayer Metallization and Via," filed on Nov. 13, 2008, the disclosure of which is incorporated herein by reference. Separation between certain parts of the CRLH antenna structure over multiple PCBs may be beneficial as to improve space limitations within the compact wireless device. The placement of the CRLH antenna structure over multiple PCBs may be configured in a variety of ways, such as elevating one or more PCBs over a main PCB, forming stacked layers of PCBs. In addition, this elevated design and techniques for implementing such design may be extended to include a combination of multiple CRLH antenna structures distributed over the main PCB substrate and the elevated PCB substrates, supporting multiple frequency bands.

Figure 15:
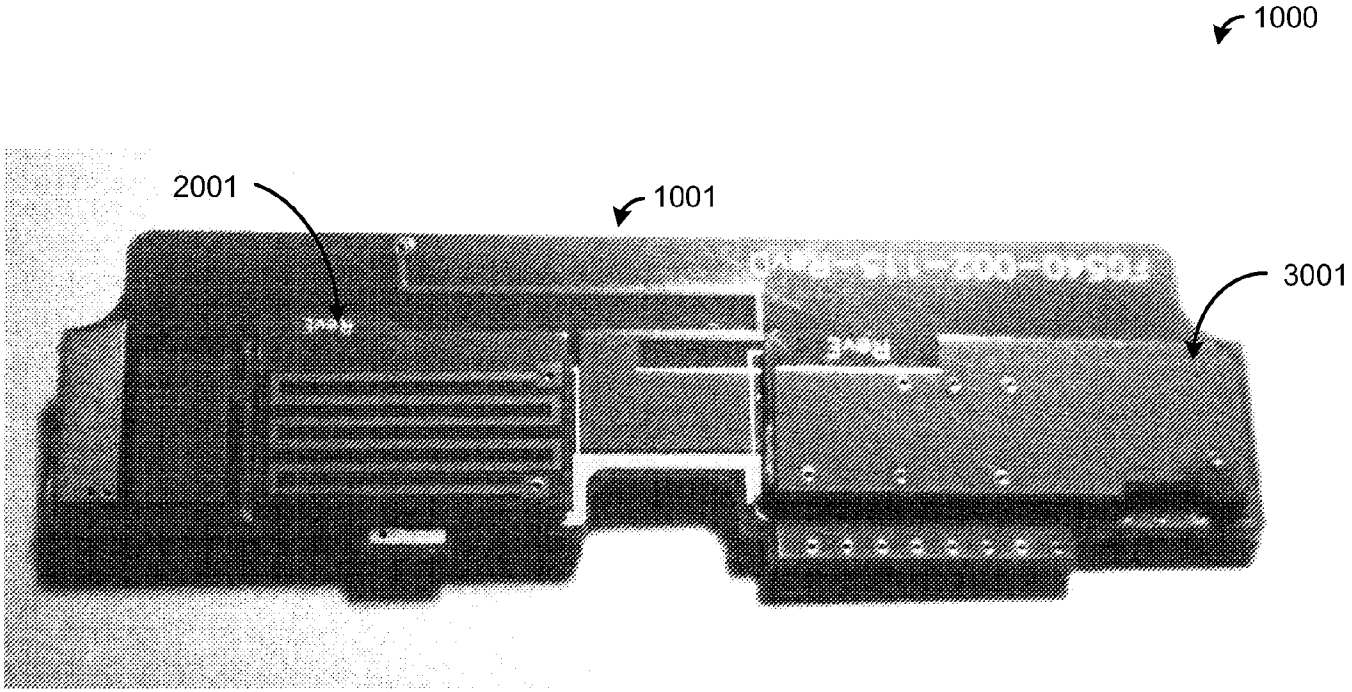
FIGS. 15-25 illustrate CRLH structures built on multiple elevated substrates, according to example embodiments.
Figure 16:
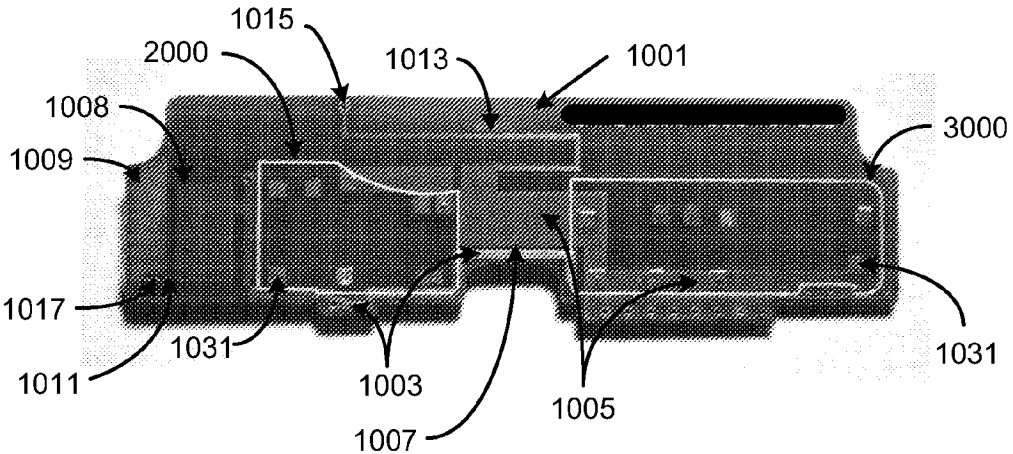
Figure 17:
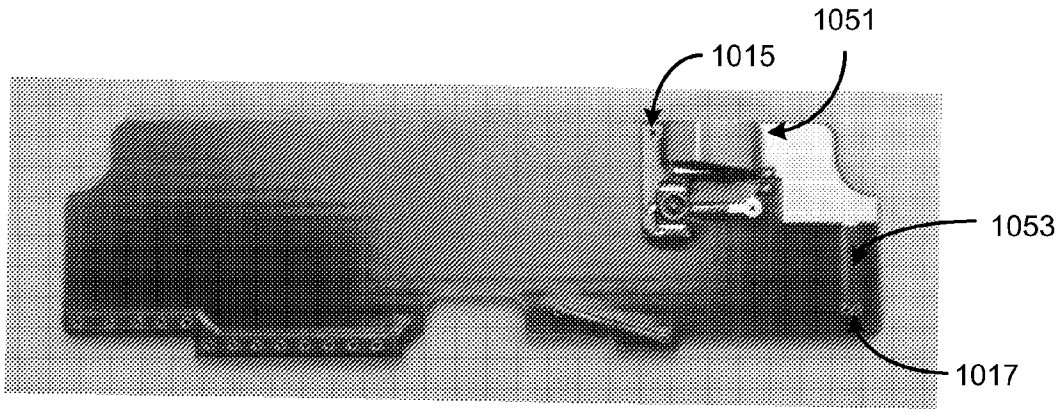
Figure 20:
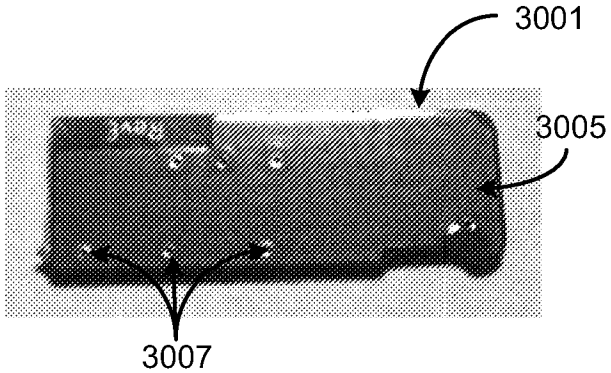
Figure 21:
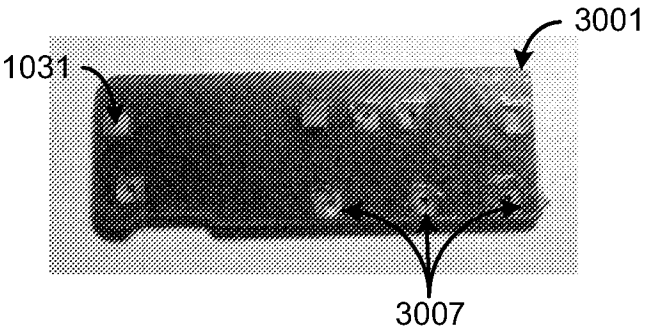
Figure 18:
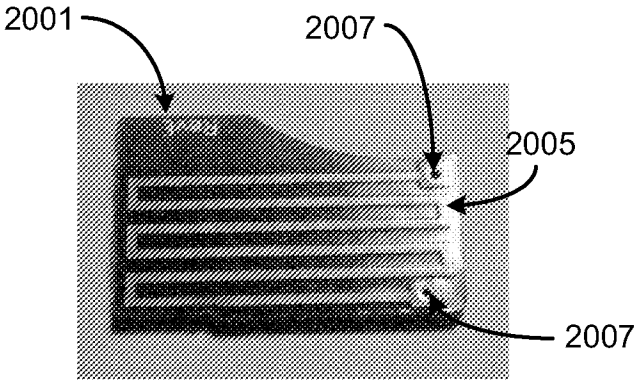
Figure 19:
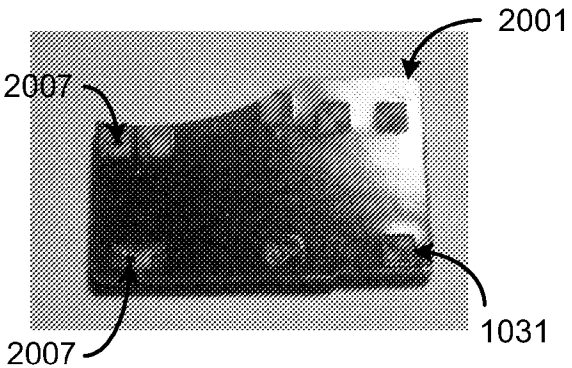

The various CRLH structures may be configured within a single layer of a substrate, within multiple layers of a substrate, on multiple substrates configured proximate each other, by way of multiple elevated components, or a combination thereof. In some embodiments, the CRLH structures are used to build multiple elevated antenna elements. FIGS. 15-21 illustrate examples of CRLH antenna device 1000 with multiple elevated antenna elements. FIG. 15 illustrates a top view of a top layer of the main substrate with a first and a second elevated substrates affixed to the main substrate, FIG. 16 illustrates a top view of a top layer of the main substrate, FIG. 17 illustrates a top view of a bottom layer of the main substrate, FIG. 18 illustrates a top view of a top layer of the first elevated PCB substrate, FIG. 19 illustrates a top view of a bottom layer of the first elevated PCB substrate, FIG. 20 illustrates a top view of a top layer of the second elevated PCB substrate, and FIG. 21 illustrates a top view of a bottom layer of the second elevated PCB substrate.

Referring to FIG. 15, the CRLH antenna device 1000 may include multiple substrates including, for example, a main substrate 1001, a first elevated substrate 2001, and a second elevated substrate 3001. Several types of CRLH antenna structures may be formed on the multiple elevated distributed substrates. However, for illustration purposes, a single feed dual cell CRLH antenna suffices to convey the details of implementing several CRLH antenna structures over the multiple elevated distributed substrates. As in FIG. 15, the main substrate and elevated substrates may be configured in various shapes and sizes, each substrate having a planar surface. Conductive elements, forming various parts of one or more CRLH antenna structures, may be constructed on the main substrate and the elevated substrate. Since the antenna device 1000 is confined to an area defined by the main substrate 1001, the use of the elevated substrates 2001 and 3001 provide yet smaller devices to be designed without requiring additional space. The planar surfaces of the first and second elevated substrates 2001 and 3001 may be fastened directly to the planar surface of the main substrate by glue, solder, or other adhesive material. In another embodiment, a soft, dielectric spacer can be sandwiched between the main substrate 1001 and the first and second elevated substrates 2001 and 3001.

Beginning with the main substrate 1001 as shown in FIG. 16, the CRLH antenna device 1000 includes a feed line 1003 and a portion of a first cell patch 1005 capacitively coupled to the feed line 1003 by a gap 1007. For the single feed dual cell CRLH antenna design, the feed line 1003 may also support an additional cell patch. Thus, the distal end of the feed line 1003, having a shape of a rectangular stub 1008, may be capacitively coupled to a second cell patch 1009 by a gap 1011. Referring to FIGS. 16 and 17, a via line 1013 is connected to a distal end of the first cell patch 1005 and provides the first cell patch 1005 a conductive path to a ground electrode 1051 located on the bottom layer of the main substrate 1001 through a first via 1015. The second cell patch 1009 is also connected to the ground electrode 1051 through a pair of second vias 1017 and a pair of via lines 1053 located on the bottom layer of the main substrate 1001. The vias 1015 and 1017 penetrate through the main substrate 1001 to provide a conductive path between top and bottom conductive elements.

The area consumed thus far by the conductive elements defining the feed line 1003, the rectangular stub 1008, the first and second cell patches 1005 and 1009, and the first via line 1013 may be insufficient to include additional conductive elements that support the CRLH antenna within the area defined by the main substrate 1001. To accommodate these additional conductive elements, additional elevated substrates 2001 and 3001 are formed within the boundaries 2000 and 3000, respectively, defined on the main substrate 1001. For example, to comply with the space requirements while maintaining a certain performance level, the first cell patch 1005 and the feed line 1003 may be extended to the elevated substrates 2001 and 3001.

Referring to FIG. 18, a meander extension 2005 is formed on the second substrate 2001 and connects to the feed line 1003 on the main substrate 1001 through vias 2007. A view of the bottom surface, as shown if FIG. 19, depicts the vias 2007 that penetrate through the second substrate 2001 and traces of adhesive material 1031 used to fasten the second substrate to the main substrate 1001.

In FIG. 20, a cell patch extension 3005 is formed on the third substrate 3001 and connects to the first cell patch 1005 through vias 3007. In FIG. 21, several vias 3007, located on the bottom layer, penetrate through the third substrate 3001. Also visible are traces of adhesive material 1031 used to fasten the second substrate to the main substrate 1001.

In this example, the performance of the CRLH antenna device is made possible by extending the cell patch and meander line within a confined area. The cell patch extension may help improve matching of the LH mode resonance, whereas the meander extension may improve matching of the monopole (RH) mode resonance.

Table 2 provides a summary of the elements of an MTM antenna structure according to such examples as illustrated in FIGS. 15-21.

TABLE 2

| Parameter | Description | Location |
|---|---|---|
| Antenna Element 1000 | Each antenna element includes two cell patches 1005 and 1009 coupled to a feed line 1003. Both cell patches 1005 and 1009 and feed line 1003 are located on the top layer of main substrate 1001. | Main Substrate 1001 |
| Feed Line 1003 | Single feed line shared by two cell patches 1005 and 1009. A stub 1008 is attached to the feed line 1005 at one end portion; and the meander line extension 2005 is attached to the feed line 1005 at another end portion. | Main Substrate 1001 |
| Cell Patch 1 1005 | Polygonal shaped and is coupled to feed line 1003 through a coupling gap 1007. | Main Substrate 1001 |
| Cell Patch 2 1009 | Polygonal shaped and is coupled to feed line 1003 through a coupling gap 1011. | Main Substrate 1001 |
| Meander Line Extension 2005 | Added to the feed line 1003 and formed on an elevated substrate. | Second Substrate (Elevated) 2001 |
| Extended Cell Patch 3005 | A polygonal shaped patch formed on an elevated substrate that is an extension of the first cell patch 1005. | Third Substrate (Elevated) 3001 |
| Via Line 1 1013 | Conductive line 1013 connects the first cell patch 1005 to a bottom ground electrode 1051. | Main Substrate 1001 |
| Via Lines 2 1053 | Conductive lines 1053 that connects the second cell patch 1009 to the bottom ground electrode 1051. | Main Substrate 1001 |
| Connecting Vias | Vias 1015, 1017 connecting the cell patch to the ground electrode;<br>Vias connecting meander line 2005 to the feed line 1003;<br>Vias connecting extended cell patch 3005 to the first cell patch 1005; | Main Substrate 1001<br>Second Substrate (Elevated) 2001<br>Third Substrate (Elevated) 3001 |

Figure 22:
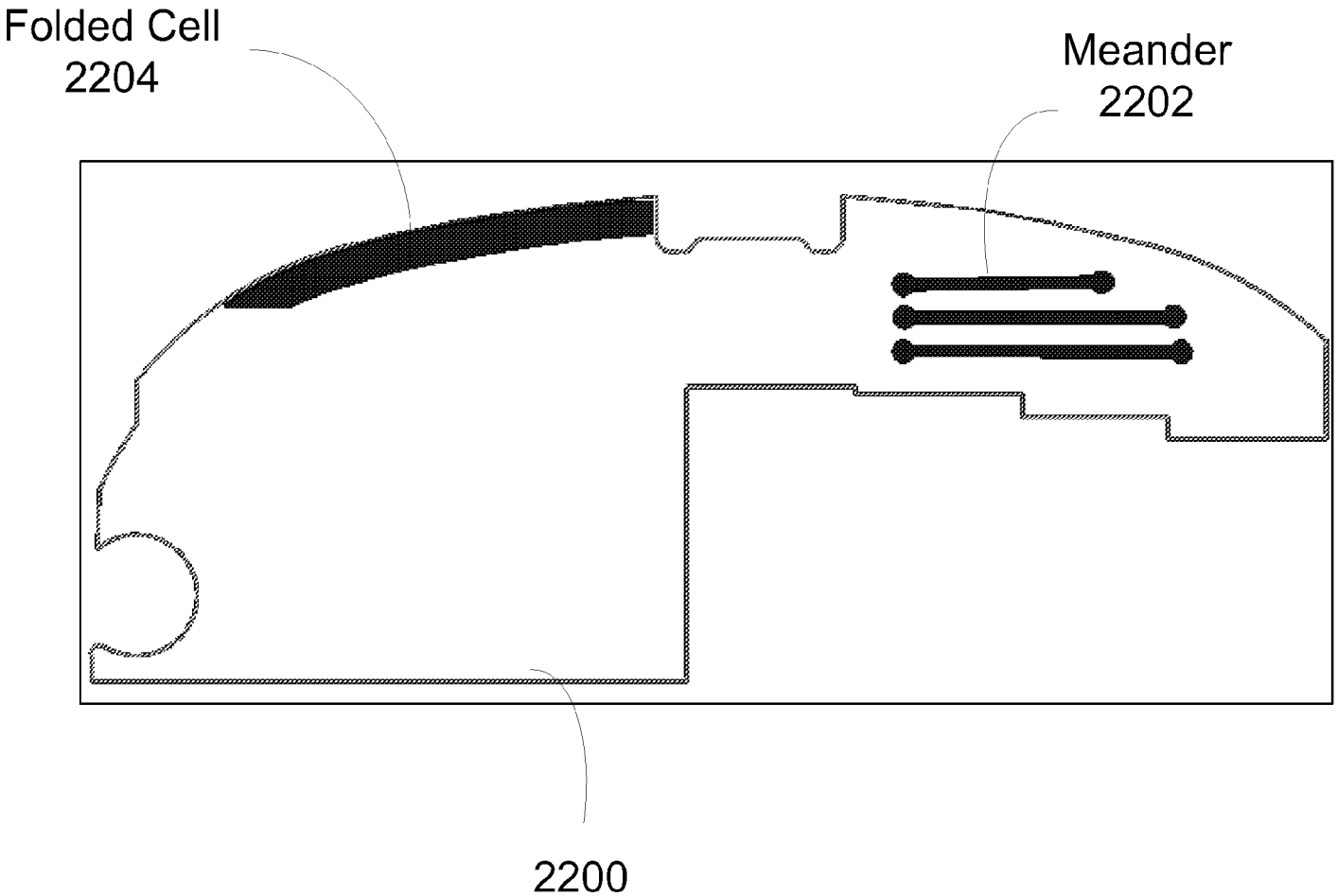
Figure 23:
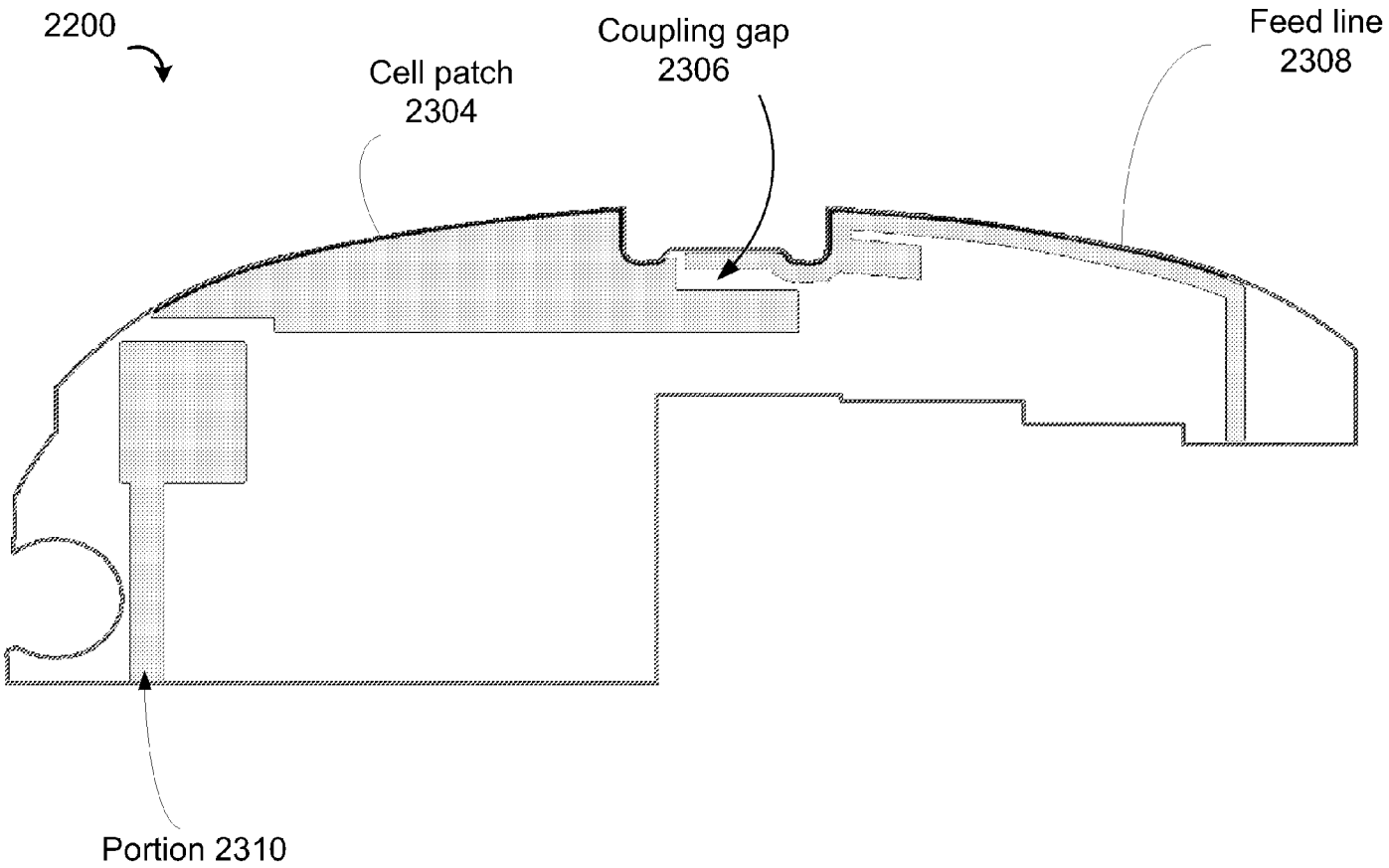

Other CRLH antenna designs include a stack PCB configuration as shown in FIGS. 22-23. Other possible design variation may have the feed line 1003 on one of the elevated substrates while portions of the extended cell patch remain on the main substrate 1001. Sophisticated CRLH antenna designs can be formed using higher numbers of elevated substrates than described in the examples given. These designs may support a variety of antenna configuration where space, performance and integration are a necessity.

FIG. 22 illustrates a top view of a top layer of a first substrate 2200. A folded cell 2204 is positioned on one edge of a side of the first substrate 2200. As illustrated in the top view, the meander 2202 is patterned on this side of the first substrate 2200. FIG. 23 illustrates a top view of a lower or bottom layer of the first substrate 2200. In one embodiment, the bottom layer is an opposite layer of a same substrate, such as a PCB having two sides. In some embodiments, the bottom layer is a separate substrate which is coupled to the first substrate 2200. As illustrated in FIG. 23, the folded cell 2204 is continuous over the edge of the first substrate 2200 and forms the cell patch 2304 on the bottom layer. The folded cell 2204 and the cell patch 2304 are one continuous conductive element that acts as the radiating element of the device. The CRLH structured device further includes a coupling gap 2306 positioned between the cell patch 2304 and the feed line 2308. The feed line 2308 is formed on the bottom layer in the illustrated example. Alternate examples may position the feed line on the top layer. The antenna may be positioned in available space on the substrate, thus allowing utilization of available space on the top and bottom layers. The substrate may have other components positioned thereon, such as portion 2310 which is not part of the antenna or radiating circuitry, but may be used for integrated peripherals or other components. FIGS. 22 and 23 illustrate a CRLH structure having a folded cell patch.

Figure 24:
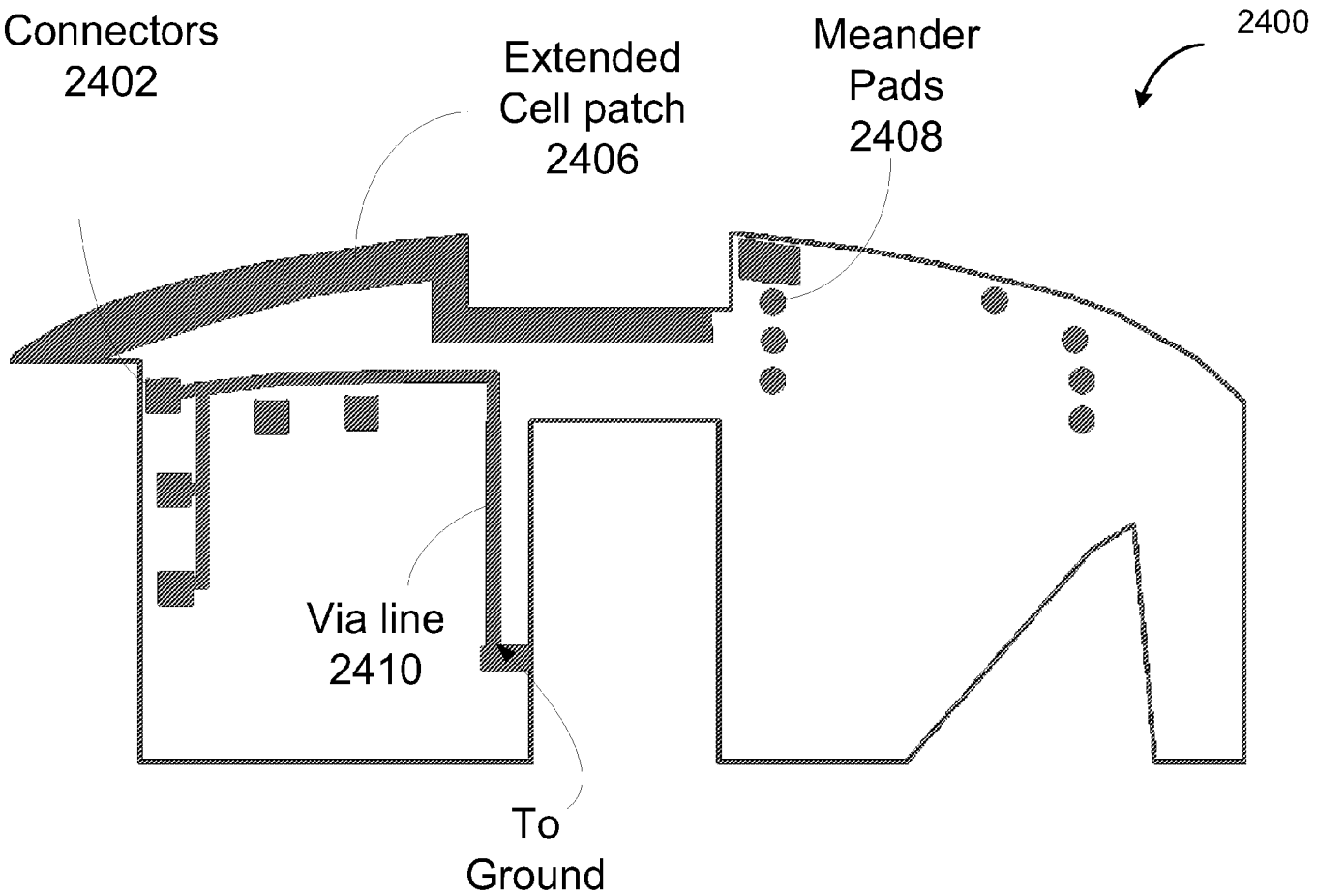

FIG. 24 illustrates a top view of a top layer of an elevated substrate 2400, such as a PCB substrate. The elevated substrate includes connections 2402 to the elevated cell patch. An extended cell patch 2406 is positioned along an outer edge of the substrate 2400, and may have a variety of shapes conforming to the available space on the top layer of the substrate 2400. Additionally, meander pads 2408 and via line 2410 are provided at various positions on the top layer. Via line 2410—is coupled to the connectors 2402 and provides a connection to ground.

Figure 25:
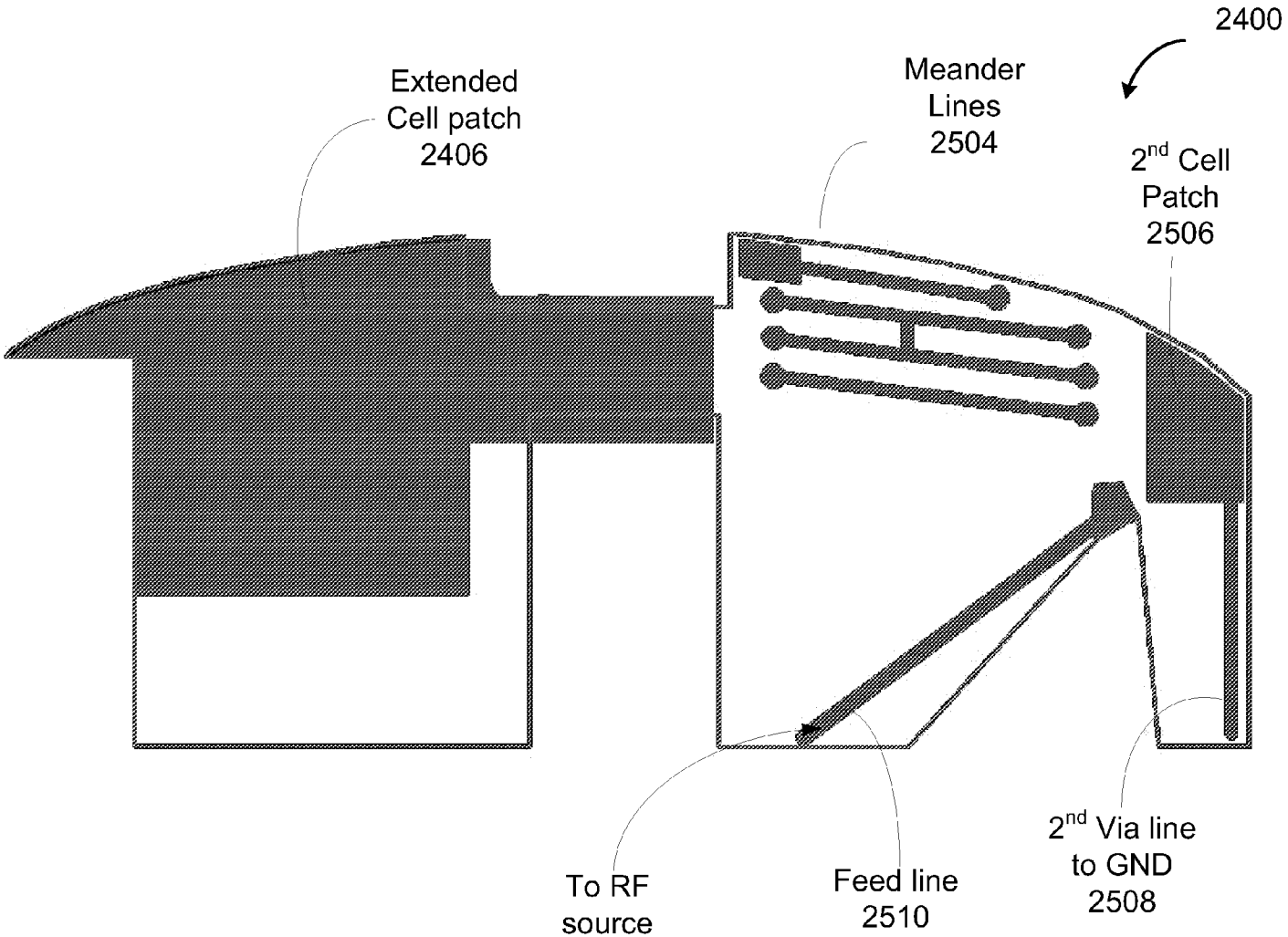

FIG. 25 illustrates a top view of a bottom layer of an elevated substrate 2400. The extended cell patch 2406 is continuous from the top layer to the bottom layer. The meander pads 2408 are coupled through the elevated substrate 2400 to the meander lines 2504 on the bottom layer. A second cell patch 2506 is patterned with a second via line 2508 coupled to ground. The feed line 2510 is then coupled to an RF source. A capacitive coupling gap is provided between the feed line 2510 and the second cell patch 2506.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Only a few implementations are disclosed. However, it is understood that variations and enhancements may be made.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Only a few implementations are disclosed. However, it is understood that variations and enhancements may be made.

What is claimed is what is described and illustrated, including:

1. A wireless device, comprising:

a substrate;

a first portion of a radiating element patterned onto a first side of the substrate;

a second portion of the radiating element patterned onto a second side of the substrate, wherein the first and second portions are patterned as a continuous conductive element;

a feed line capacitively coupled to the radiating element; and a via line coupled to the radiating element, the via line further coupled to a reference ground, wherein the radiating element is positioned outside of a footprint of the reference ground.

2. The wireless device of claim 1, further comprising a Composite Right and Left Handed (CRLH) metamaterial antenna structure, wherein the first portion and the second portion of the radiating element form a continuous cell patch of the CRLH metamaterial antenna structure.

3. The wireless device of claim 2, wherein the CRLH metamaterial antenna structure includes a unit cell, comprising:

the feed line;

the continuous cell patch; and the via line.

4. The wireless device of claim 1, comprising a meander line coupled to the feed line.

5. The wireless device of claim 1, further comprising:

a component area, wherein the first portion of the radiating element located on the first side of the substrate includes regions patterned proximate a first side of the component area and patterned proximate a second side of the component area, and wherein the second portion of the radiating element located on the second side of the substrate includes a region patterned opposite the component area.

6. The wireless device of claim 5, wherein the component area includes a microphone area.

7. The wireless device of claim 1, wherein the feed line further comprises a launch pad capacitively coupled to the radiating element.

8. The wireless device of claim 1, wherein the substrate is an FR-4 material.

9. The wireless device of claim 1, wherein the substrate comprises a keypad connection area.

10. The wireless device of claim 1, wherein the radiating element conforms to a shape of the substrate.

11. The wireless device of claim 1, wherein the radiating element includes a portion arranged to fold around an edge of the substrate to provide the continuous conductive element.

12. The wireless device of claim 1, wherein the feed line is patterned on the first surface of the substrate.

13. The wireless device of claim 1, wherein the feed line is patterned on the second surface of the substrate.

14. A Composite Right and Left Handed (CRLH) metamaterial antenna device, comprising:

a substrate; and a unit cell, including:

a first portion of a radiating element patterned onto a first side of the substrate;

a second portion of the radiating element patterned onto a second side of the substrate;

a third portion located on an edge of the substrate between the first and second sides of the substrate;

a feed line capacitively coupled to the radiating element; and a via line coupled to the radiating element, the via line further coupled to a reference ground, wherein the radiating element is positioned outside of a footprint of the reference ground, and wherein the first, second, and third portions of the radiating element are arranged as a continuous conductive element to provide a continuous cell patch of the unit cell.

15. A method for providing an antenna structure, comprising:

forming a reference ground on a substrate;

forming a first portion of a radiating element on a first side of a substrate;

forming a second portion of the radiating element on a second side of the substrate;

forming a third portion located on an edge of the substrate between the first and second sides of the substrate;

forming a feed line capacitively coupled to the radiating element; and forming a via line coupled to the radiating element, the via line further coupled to the reference ground, wherein the radiating element is positioned outside of a footprint of the reference ground, and wherein the first, second, and third portions of the radiating element are arranged as a continuous conductive element.

16. The method of claim 15, wherein providing the antenna structure further comprises forming a Composite Right and Left Handed (CRLH) metamaterial antenna structure including a unit cell, the unit cell including the radiating element, the feed line, and the via line.

17. The method of claim 15, further comprising forming a meander line coupled to the feed line.

18. The method of claim 15, further comprising forming a component area on the substrate, wherein the first portion of the radiating element located on the first side of the substrate includes regions formed proximate a first side of the component area and formed proximate a second side of the component area, and wherein the second portion of the radiating element located on the second side of the substrate includes a region formed opposite the component area.

19. The method of claim 15, wherein forming the feed line further comprises forming a launch pad capacitively coupled to the radiating element.

20. The method of claim 15, wherein forming the radiating element further comprises conforming the radiating element to a shape of the substrate.

* * * * *